US006558011B2

(12) United States Patent
Fritz

(10) Patent No.: US 6,558,011 B2
(45) Date of Patent: May 6, 2003

(54) REFLECTIVE MARKER

(75) Inventor: Raymond J. Fritz, Northfield, OH (US)

(73) Assignee: The Technology House, LTD, Solon, OH (US)

( * ) Notice: Subject to any disclaimer, the term of this patent is extended or adjusted under 35 U.S.C. 154(b) by 0 days.

(21) Appl. No.: 09/993,445

(22) Filed: Nov. 19, 2001

(65) Prior Publication Data

US 2002/0063960 A1 May 30, 2002

Related U.S. Application Data

(60) Provisional application No. 60/253,888, filed on Nov. 29, 2000.

(51) Int. Cl.[7] ..... G02B 5/12
(52) U.S. Cl. ..... 359/552; 359/547; 359/553
(58) Field of Search ..... 359/515, 547, 359/552, 529, 530, 532, 542

(56) References Cited

U.S. PATENT DOCUMENTS 3,916,815 A * 11/1975 Valley ..... 116/63 P
4,061,435 A * 12/1977 Schmanski et al. ..... 256/1
4,252,409 A * 2/1981 Schwab ..... 359/527
5,611,165 A * 3/1997 Blaha ..... 239/58
2002/0035959 A1 3/2002 Bukky

* cited by examiner

*Primary Examiner*—James Phan
*Assistant Examiner*—Joshua Pritchett
(74) *Attorney, Agent, or Firm*—Rankin, Hill, Porter & Clark, LLP

(57) ABSTRACT

The present invention provides a reflective marker such as is used to delineate the location of a road, driveway or parking area. A reflective marker according to the invention includes a support post and a head fastened to the support post. The head includes a top portion and a bottom portion that are spanned by a generally cylindrical shell portion, which is preferably multi-faceted. Means are disposed on the shell portion for reflecting incident light directed thereat over a 360° range. Preferably, the reflective means comprises reflective tape having a width of from about 1.5 to about 3.5 inches. In the presently most preferred embodiment of the invention, the head is constructed of a polymeric material, and the support post is constructed of fiberglass.

10 Claims, 5 Drawing Sheets

REFLECTIVE MARKER

FIELD OF INVENTION

The present invention provides a reflective marker.

BACKGROUND OF THE INVENTION

Reflective markers are used, for example, to delineate the location of the edge of a driveway, road, or parking area. Most commonly, reflective markers comprise substantially planar reflectors formed from a plastic material that are fastened to a support structure such as a pole or tree adjacent to a driveway, road, or parking area to be marked. Reflective markers of this type reflect incident light over a relatively narrow range of angles perpendicular to the plane of the reflector. In addition, reflective markers of this type generally have an unsightly appearance that does not blend in well with surrounding landscaping and architecture. A reflective marker is needed that can overcome these limitations.

SUMMARY OF INVENTION

The present invention provides a reflective marker such as is used to delineate the location of a road, driveway or parking area. A reflective marker according to the invention comprises a support post and a head fastened to the support post. The head comprises a top portion and a bottom portion that are spanned by a generally cylindrical shell portion, which is preferably multi-faceted. Means are disposed on the shell portion for reflecting incident light directed thereat over a 360° range. Preferably, the reflective means comprises reflective tape having a width of from about 1.5 to about 3.5 inches. In the presently most preferred embodiment of the invention, the head is constructed of a polymeric material, and the support post is constructed of fiberglass.

The support post of the reflective marker according to the invention can then be pressed into the ground in the location desired for marking without any special tools. In the presently most preferred embodiment of the invention, and the head of the reflective marker has the shape of a lantern, which is aesthetically pleasing and can be made to be compatible with surrounding landscaping and architecture. The reflective portion of the reflective marker according to the invention takes on the appearance of the lighted window area of a lantern. Because the reflective means is disposed around the shell for 360°, the reflective marker is highly effective when viewed from 360°.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF PREFERRED EMBODIMENTS

Figure 1:
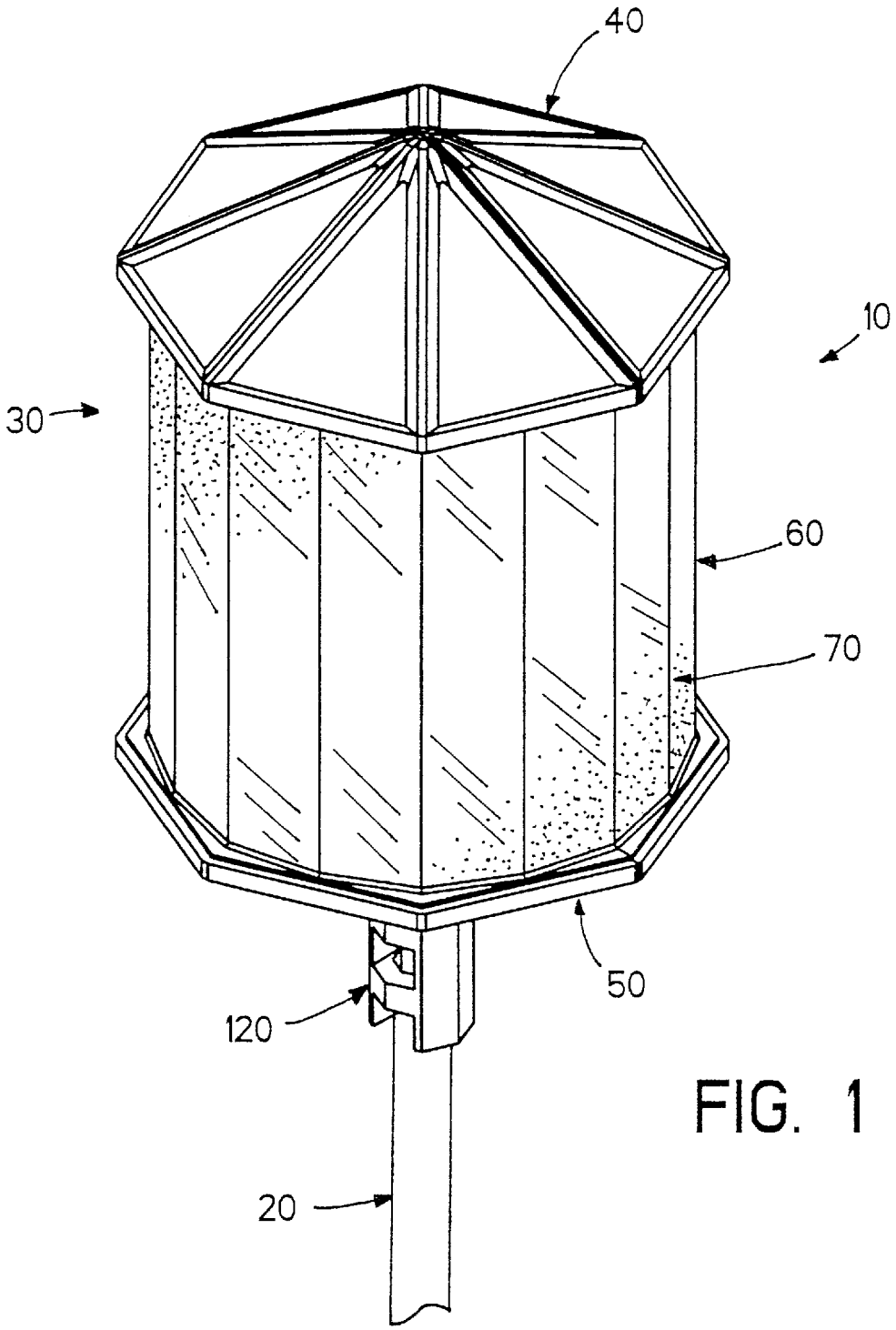
FIG. 1 is a perspective view of a portion of a reflective marker according to the invention.
Figure 2:
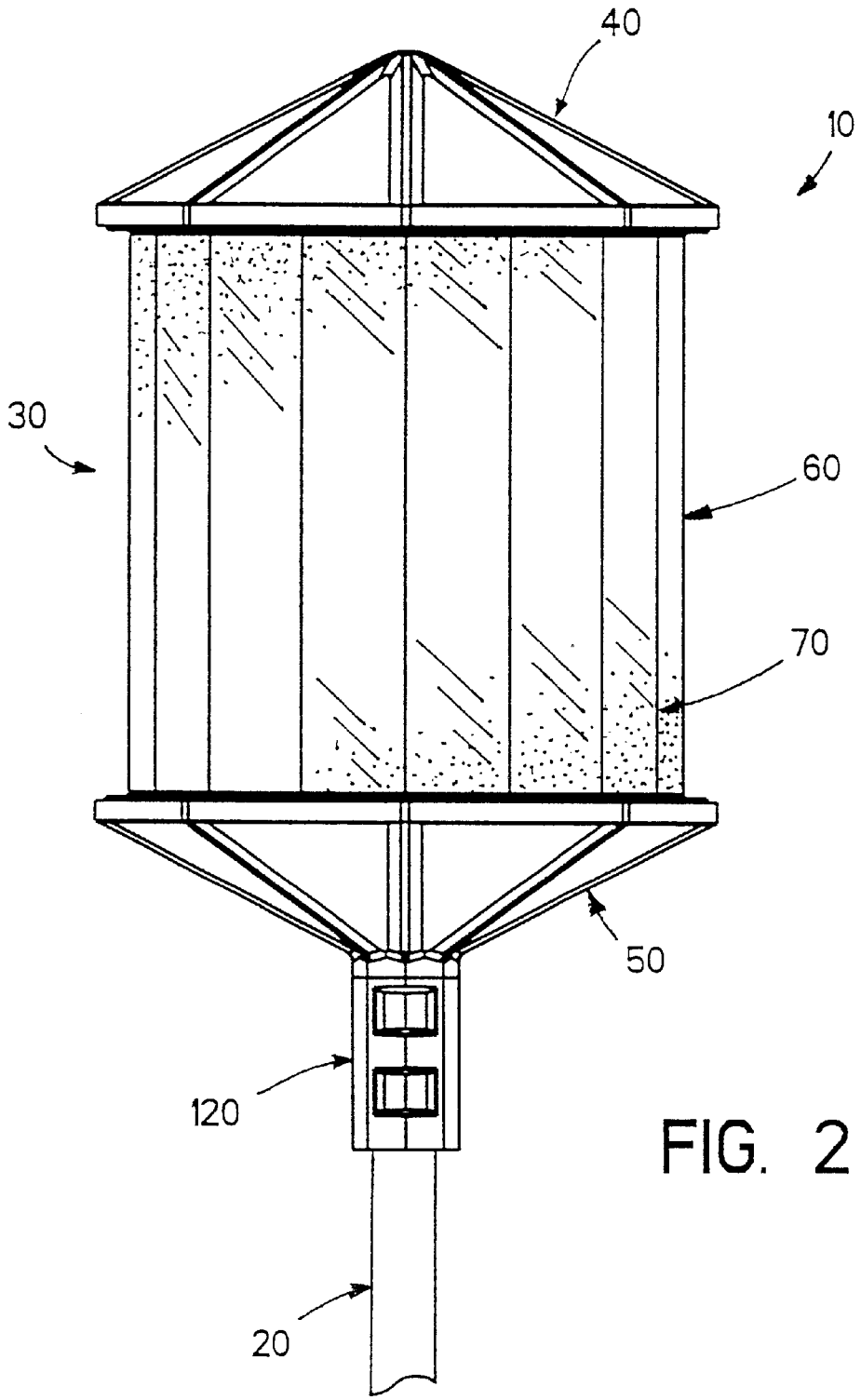
FIG. 2 is a front view of that portion of the reflective marker shown in FIG. 1.
Figure 4:
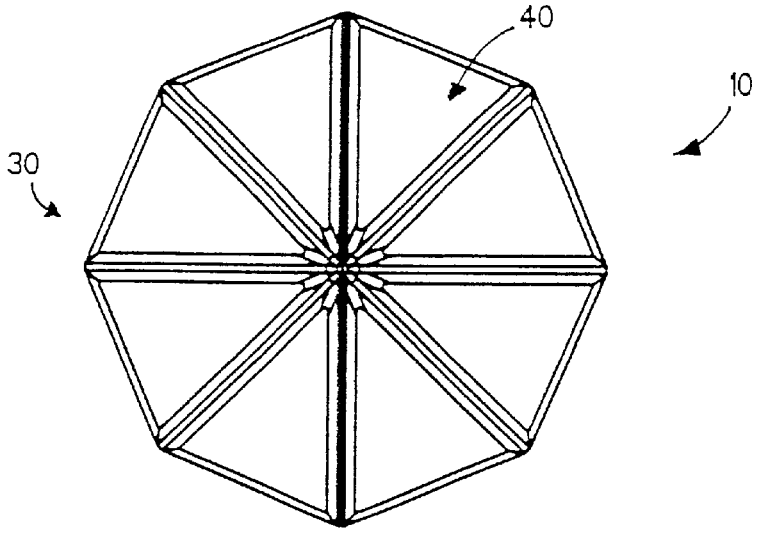
FIG. 4 is a top view of the reflective marker shown in FIG. 1.
Figure 3:
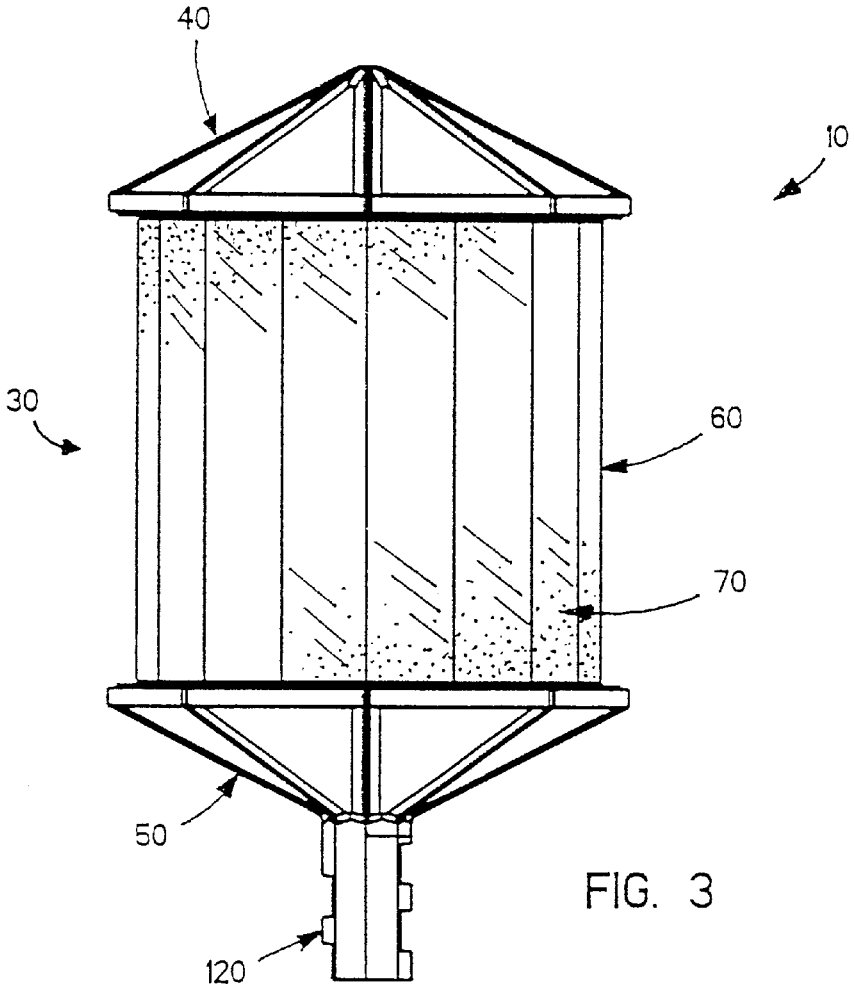
FIG. 3 is a side view of the head of the reflective marker shown in FIG. 1.

The present invention provides a with reference to FIGS. 1 to 4, a reflective marker 10 according to the present invention comprises a support post 20 and a head 30 fastened to the support post 20. The head 30 comprises a top portion 40 and a bottom portion 50 that are spanned by a shell portion 60, that is preferably generally cylindrical in shape. Reflective means 70 are disposed on the shell portion 60 for reflecting incident light directed thereat over a 360° range.

In the most preferred embodiment of the invention, the shell portion 60 is multi-faceted. The shell portion 60 extends 360° around the head 30 providing a plurality of generally planar vertical facets that span from the top portion 40 to the bottom portion 50. The facets increase the effectiveness of the reflective means 70 by providing a relatively large planar reflecting surface over the entire 360° angle. The shell portion 60 can be constructed without facets, but the reflectiveness is reduced.

In the preferred embodiment, the reflective means 70 comprises reflective tape such as the reflective tape available under the trade designation NIKKALITE by Nippon Carbide Industries (USA), Inc. The reflective means 70 can also comprise individual reflectors. The color of the reflective means 70 is not per se critical, but applicant has found that a white or yellow color is easy to see at night and is aesthetically pleasing when the head 30 is formed in the shape of a lantern. Preferably, the reflective means 70 is from about 1.5 to about 3.5 inches in width, with a width of 2.5 inches being most preferred. The head 30 is therefore preferably about 4" in total height.

Figure 5:
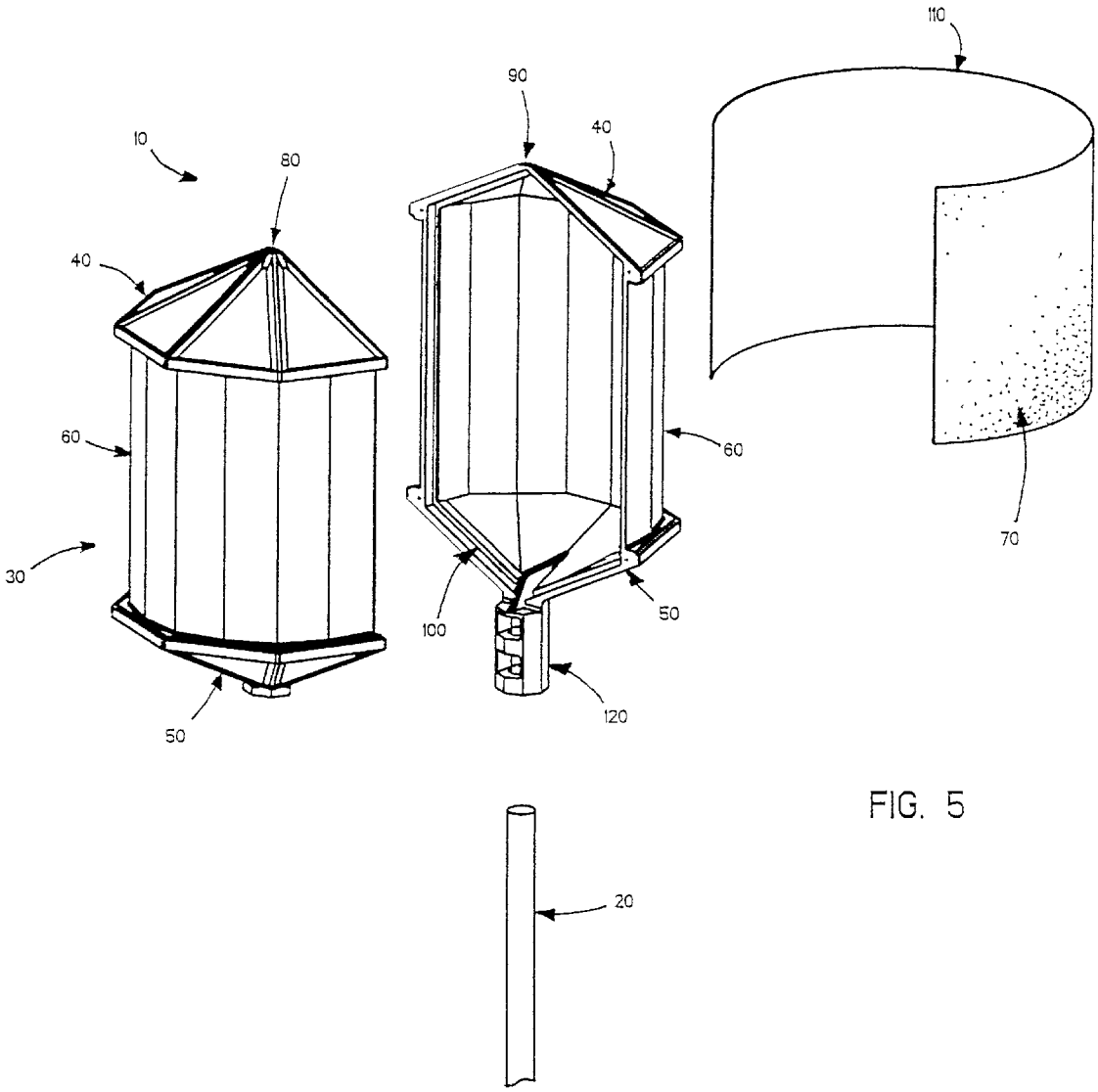
FIG. 5 is an exploded perspective view of that portion of the reflective marker shown in FIG. 1.

The head 30 is preferably constructed of a polymeric material such as, for example, injection molded polypropylene. With reference to FIG. 5, the head 30 is preferably formed by joining a first half 80 to a second half 90. The first half 80 and second half 90 are formed such that when pressed together they engage each other by means of an overlapping joint 100, which preferably extends around the entire mating surfaces of the first half 80 and second half 90. The two halves 80, 90 can be secured together by any means, such as screws, adhesives, snap fits, heat welding or sonic welding the plastic. However, when reflective tape 110 is used as the reflective means 70, the reflective tape 110 can be used to secure the two halves 80, 90 together. In the presently most preferred embodiment, applicant uses a combination of screws and reflective tape to hold the two halves 80, 90 together.

The support post 20 is preferably constructed of fiberglass. However, it could also be constructed of some other material such as plastic, metal or wood. The support post 20 must be strong enough to support the head and to allow for insertion into the ground. A fiberglass rod having a diameter of from about ⅜" to about ⅝" is particularly suitable for this purpose.

The head 30 is fastened to the support post 20. In the preferred embodiment of the invention, the bottom portion 50 of the head 30 is fastened to the support post 20. However, it will be appreciated that the top portion 40 of the head 30 could be fastened to the support post 20 such that the head appears to look like a hanging lantern.

The manner in which the head 30 is fastened to the support post 20 is not per se critical. However, in the presently most preferred embodiment of the invention, the head 30 is fastened to the support post 20 using a standing boss 120. One end of the support post 20 is pressed tightly into the standing boss 120 in order to hold the head 30 to the support post 20.

Figure 6:
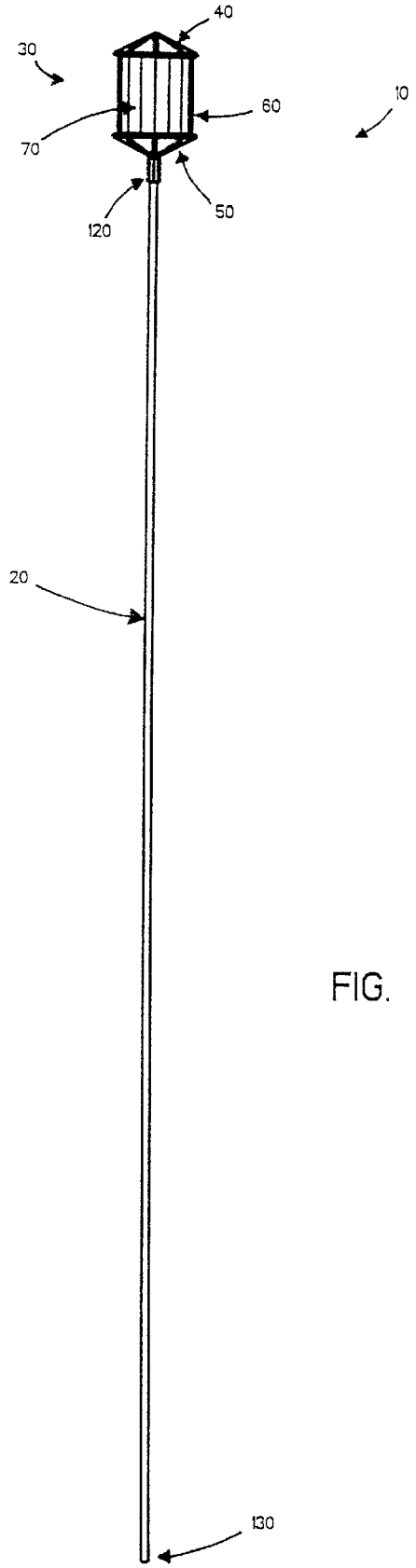
FIG. 6 is a side view of the reflective marker shown in FIG. 1.

In the most preferred embodiment of the invention illustrated in FIG. 6, the head 30 sits atop the support post 20. The lower end 130 of the support post 20 is fixed into the ground. The support post 20 can be of any length, but a length of from about 36" to about 60", and most preferably about 48" in length, is most preferred. This height is very effective for marking the edge of a road or driveway. The reflective surface can effectively reflect incident light emanating from any direction 360° around the reflective marker. A reflective marker according to the present invention can be made to appear as a lantern or some other structure that is compatible with surrounding landscaping and architecture.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A reflective marker comprising:

a hollow head formed by joining two mating halves together at an overlapping joint, said head having a closed top portion, a closed bottom portion, and a generally cylindrical shell portion that spans the top portion and the bottom portion;

a support post fastened to said bottom portion of said head; and reflective tape disposed on said shell portion for reflecting incident light directed thereat over a 360° range.

2. The reflective marker according to claim 1 wherein said reflective tape has a width of from about 1.5 to about 3.5 inches.

3. The reflective marker according to claim 1 wherein said head is constructed of a polymeric material.

4. The reflective marker according to claim 1 wherein said support post is constructed of fiberglass.

5. The reflective marker according to claim 1 wherein said shell portion is multi-faceted.

6. The reflective marker according to claim 1 wherein said head has the shape of a lantern.

7. A reflective marker comprising:

a hollow head formed by joining two mating halves together at an overlapping joint, said head having a closed top portion, a closed bottom portion, and a generally cylindrical multi-faceted shell portion that spans the top portion and the bottom portion;

a support post fastened to said bottom portion of said head; and means disposed on said shell portion for reflecting light directed toward said shell from any direction 360° around said support post.

8. The reflective marker according to claim 7 wherein said shell has four facets.

9. The reflective marker according to claim 7 wherein said marker is used to delineate the location of the edge of a driveway, road, and/or parking area.

10. The reflective marker according to claim 7 wherein said support post further comprises a tip opposite said head that can be pressed into the ground without any special tools.

* * * * *